US005855314A

United States Patent [19]

Shiue et al.

[11] Patent Number: 5,855,314

[45] Date of Patent: Jan. 5, 1999

[54] ABRASIVE TOOL CONTAINING COATED SUPERABRASIVE GRAIN

[75] Inventors: Ren-Kae Shiue, Taipei, Taiwan; Sergej-Tomislav Buljan, Acton, Mass.; Bradley J. Miller, Westboro, Mass.; Eric Schulz, Worcester, Mass.; Thomas W. Eagar, Belmont, Mass.

[73] Assignee: Norton Company, Worcester, Mass.

[21] Appl. No.: 813,145

[22] Filed: Mar. 7, 1997

[51] Int. Cl.[6] ..... B23K 1/19

[52] U.S. Cl. ..... 228/124.5; 228/248.5

[58] Field of Search ..... 228/122.1, 124.1, 228/124.5, 208, 254, 203, 204, 248.5

[56] References Cited

U.S. PATENT DOCUMENTS

| | | | |
|---|---|---|---|
| 3,178,273 | 4/1965 | Libal | 51/293 |
| 3,596,649 | 8/1971 | Olivieri | 125/11 |
| 3,779,873 | 12/1973 | Dewar | 204/20 |
| 3,894,673 | 7/1975 | Lowder et al. | 228/122 |
| 3,925,035 | 12/1975 | Keat | 51/309 |
| 4,018,576 | 4/1977 | Lowder | 51/309 |
| 4,334,895 | 6/1982 | Keat | 51/309 |
| 4,618,349 | 10/1986 | Hashimoto et al. | 51/298 |
| 4,685,440 | 8/1987 | Owens | 125/11 |
| 4,749,594 | 6/1988 | Malikowski et al. | 427/190 |
| 4,951,427 | 8/1990 | St. Pierre | 51/293 |
| 4,968,326 | 11/1990 | Wiand | 51/293 |
| 5,011,511 | 4/1991 | Beck | 51/295 |
| 5,102,621 | 4/1992 | Sara | 420/470 |
| 5,178,643 | 1/1993 | Schimweg | 51/293 |
| 5,232,469 | 8/1993 | McEachron et al. | 51/295 |
| 5,308,367 | 5/1994 | Julien | 51/293 |
| 5,385,591 | 1/1995 | Ramanath et al. | 51/309 |
| 5,453,105 | 9/1995 | Middlemiss et al. | 51/307 |
| 5,492,771 | 2/1996 | Lowder et al. | 428/565 |
| 5,505,750 | 4/1996 | Andrews | 51/309 |

FOREIGN PATENT DOCUMENTS

| | | | |
|---|---|---|---|
| 1086509 | 7/1977 | Canada | B24D 3/10 |
| 480878 | 8/1991 | European Pat. Off. | B24D 3/06 |

OTHER PUBLICATIONS

R.B. Aronson, "CBN Grinding—a tempting technology", Manufacturing Engineering, Feb. 1994, p. 35.

J.A. Borkowski and A.M. Szymanski, "Uses of Abrasives and Abrasive Tools", Ellis Horwood Ltd., 1992.

M. M. Schwartz, "Brazing", ASM International, 1987.

G. Humpston and D.M. Jacobson, "Principles of Soldering and Brazing," ASM International, 1993.

M.M. Schwartz, "Ceramic Joining, " ASM International, 1989 pp. 99–111.

"ASM Handbook," vol. 6, ASM International, 1993, pp. 911–913.

R. W. K. Honeycombe, Steels–Microstructure and Properties, 1996 pp. 55–63.

J.F. Elliot and M. Gleiser, Thermochemistry for Steelmaking, vol. 1., 1960, Figure 7.

H.K. Lee and J.Y. Lee, "Decomposition and Interfacial Reaction in Brazing of SiC by Copper–Based Active Alloys," Journal of Materials Science Letters, 11, 1992, pp. 550–553.

J.Wilks and E. Wilks, "Properties and Applications of Diamond," Butterworth–Heinemann Ltd., 1991.

Warnecke, G. and Wimmer J., "Stock Removal and Wear in Deep Grinding High–Performance Ceramics," Industrial Diamond Review, 55(566), pp. 126–132, 1995.

Murakawa, Masao; Takeuchi, Sadao; "Forming of a grinding wheel using a dresser with brazed diamond film", *Materials Science & Engineering A: Structural Materials: Properties, Microstructure and Processing vA140 n*, Jul. 7, 1991 pp. 759–763.

Stasyuk, L.F.; Kisikov, E.D.; Kushtalova, I.P.; "Structure and Properties of a Diamond–Containing Composition Material with a Tungsten–Free Matrix for a Truing Tool", *Metal Science and Heat Treatment, v 28 n* Nov.–Dec. 1986 pp. 835–839.

Kushtalova, I.P.;Stasyuk, L.F.; Kisikov, E.D.; "Development of a Diamond Containing Material With a Tungsten–Free Matrix for Dressing Tools", *Soviet Journal of Superhard Materials v 8 n 1*, Nov., 1986 pp. 48–51.

Kirk–Othmer, *Engyclopedia of Chemical Technology* 4th Ed., vol. 4., 1991 pp. 1082–1092.

Tech. Service Bulletin of Tomei Diamond *Tomei's Comprehensive Product Line Up*, undated.

Tech. Service Bulletin of General Electric *An Analysis of the Coated Diamond Bond System*, undated.

Tech. Service Bulletin of De Beers Industrial Diamond Division *De Beers–80 US Mesh Diamond Abrasives*, 1985.

Tech. Service Bulletin of American Boarts Crushing *Industrial Diamonds for the Petroleum Industry*, undated.

*Primary Examiner*—Samuel M. Heinrich
*Attorney, Agent, or Firm*—Mary E. Porter

[57] ABSTRACT

An abrasive grit for a metal bonded Single Layer abrasive tool includes abrasive grains coated with a first active component. The active component is mechanically-bound to the surface of the superabrasive grains. Preferably the abrasive is a superabrasive, especially diamond, and the first active component is titanium, either in the form of elemental Ti or $TiH_2$. The novel grit is made by mixing the first active powder component in a liquid binder to form an adhesive paste; mixing the paste with the abrasive grains to wet the grains, and drying the mixture to adhere active component to the grains. The coated abrasive can be brazed onto a core to form a Single Layer tool, especially with a brazing composition that includes a bronze alloy and small concentrations of a second active component. During brazing the novel abrasive grains provide excellent surface contact with the brazing composition and the braze strongly bind the grains to the tool core. The brazed composition is easy to chemically or electrochemically strip from the cores of worn abrasive tools to permit reconstruction of the tools.

14 Claims, No Drawings

ABRASIVE TOOL CONTAINING COATED SUPERABRASIVE GRAIN

FIELD OF THE INVENTION

This invention relates to active brazed, Single Layer superabrasive grinding tools, and, more specifically, tools made with superabrasive grain coated with a first active powdered component, such as titanium.

BACKGROUND

Certain abrasive tools for industrial applications usually have an abrasive portion of grains embedded in a bond. This abrasive portion is normally affixed to a rigid core. The core can be adapted for manual or power driven motion in contact with a work piece to grind, cut, polish or otherwise abrade the work piece to a desired shape.

Among other things, the abrasive grains should be harder than the material being ground to penetrate the surface and to remove chips from the work piece. Very hard, so-called "superabrasive" substances, such as diamond and cubic boron nitride ("CBN"), are especially useful for cutting hard or difficult to cut materials. For example, diamond can grind tungsten carbide, natural stone, granite, concrete and ceramics. Diamond is not well suited for grinding iron or steel, however. Importantly, CBN can cut ferrous materials.

Because superabrasives are relatively expensive, it is economically advantageous to reduce the amount of superabrasive on a grinding tool. In one type of abrasive tool (a "Single Layer" abrasive tool) a very small amount of abrasive is deposited in a substantially one grain thickness layer on the operative surface of the core and the abrasive grain is bonded to the core by a metal bond. This bond can be achieved by such methods as electroplating and brazing. Of these two methods, brazing is preferred because electroplating generally requires maintaining a large inventory of expensive superabrasive grains in an electroplating bath.

Sometimes the metal bond can be the service life determining factor for a Single Layer abrasive tool. Composition of the bond affects its bonding strength. Unless the bond is strong, repetitive impact against the work will tear superabrasive grains from the core prematurely, i.e., while the superabrasive grains remain sharp and capable of further cutting. The bond also is normally softer than the work piece. Direct contact with the work piece or with swarf can erode the bond which also permits early release of sharp particles.

Recent technological developments have sought to improve the strength of brazed bonds. For example, U.S. Pat. No. 4,968,326 discloses a method of making a Single Layer diamond abrading tool with good bond strength that can be varied to desired degree. The method employs a brazing material containing a carbide forming element, preferably molybdenum or iron. The patented method also has the stated advantage that the carbide and braze layers tend to climb up the side of the diamond particles. This surface "wetting" phenomenon increases the interface between abrasive particle and bond on which the bond may act, and thus strengthens the bonding power of the braze. In U.S. patent application Ser. No. 08/693,763 filed Aug. 7, 1996, it has been proposed to include in a bronze-based braze, particles of active components, such as titanium, zirconium, titanium carbide, or mixtures of them. These active components can react with the abrasive particle at the surface to form a stronger chemical bond.

Adding active metal such a titanium to the bond composition has a disadvantage. The additive can react with other elements in the composition during brazing to form intermetallic compounds. These intermetallics are weaker than the braze and dilute the remaining braze that is present. Thus the intermetallic compounds detract from the mechanical properties of the braze. Additionally, the intermetallics can adhere the braze very strongly to the metal of the core. This adhesion makes chemical or electrochemical stripping of the braze from worn out tools more difficult. Stripping is an important process in the recovery of recycled tool cores. The ability to recover used cores increasingly affects tool production cost, particularly with respect to large tools for the construction industry, such as large diameter grinding wheels for ferrite.

Consequently, it is desirable to incorporate active metal in the braze composition to strengthen the bond; however, it is also advantageous to minimize active metal in the braze composition to reduce the formation of intermetallics. It now has been discovered that strong bonds for Single Layer abrasive tools can be made with greatly reduced amounts of active component, e.g., 0.5 to 3.0 wt % of the braze composition. The discovery involves use of superabrasive grains coated with a mechanically bound layer of a first active component together with a braze composition containing a second active component. The total amount of active component present in the resulting brazed composition is much less than necessary for conventional bonds made by only incorporating an active component in the braze composition. While creating a strong bond to the superabrasive, the resulting brazed composition leaves little active component available for intermetallic formation and thereby strengthens the bond and facilitates stripping the braze from worn tools.

SUMMARY OF INVENTION

Accordingly, the present invention provides a process for making an abrasive tool having a metal core comprising the steps of:

(A) mixing to a uniform composition a first active component and an effective amount of a liquid binder to form an adhesive paste;

(B) mixing superabrasive grains, each having a surface area, with an effective amount of the adhesive paste to wet a major fraction of the surface area of the superabrasive grains with the paste;

(C) drying the liquid binder thereby producing coated superabrasive grains having a mechanically bound surface coating >1 micron in thickness of the first active component;

(D) coating an operative surface of the core with an effective amount of a brazing composition comprising a second active component;

(E) depositing a Single Layer of coated superabrasive grains into the brazing composition on the operative surface of the metal core;

(F) heating the coated metal core under an inert atmosphere to remove substantially all liquid binder; and (G) brazing the coated superabrasive grains to the core at a temperature of at least 700° C. to effect a reaction between the superabrasive grains, the first active component and the second active component.

The invention further provides an abrasive tool comprising:

a metal core having an operative surface; and a one grain thick layer of superabrasive grains brazed to the operative surface; each grain being coated with a macromolecular thickness of a first active component exclusively mechanically bound to the superabrasive grains prior to brazing; and a brazed composition on the operative surface, being the brazed product of a brazing composition including:

(1) about 100 parts by weight of a bronze alloy consisting essentially of about 10–30 wt % tin and a complementary amount of copper; and (2) about 0.5–7 parts by weight of a powder of a second active component.

The invention includes a coated abrasive grit suitable for brazing to a core of a Single Layer abrasive tool, the coated abrasive grit comprising superabrasive grains each grain being coated with a macromolecular thickness of about 4 to 150 microns of a first active component, the coating being exclusively mechanically bound to the grain by a process comprising the steps of:

(A) mixing to uniform composition a powder of the first active component and an effective amount of a liquid binder to form an adhesive paste;

(B) mixing superabrasive grains, each grain having a surface area, with an effective amount of the adhesive paste to wet at least a major fraction of the surface area of the superabrasive grains with the adhesive paste; and (C) drying the liquid binder.

The coated abrasive grit is preferably diamond or cubic boron nitride, coated with about 4 to 150 microns of elemental titanium or titanium hydride and the coated abrasive grit is preferably used in a bronze braze containing about 0.5 to 3.0 weight % of elemental titanium or titanium hydride.

DETAILED DESCRIPTION

This invention is primarily useful in Single Layer abrasive tools manufactured by the active brazing method. Active brazing represents an advance over basic brazing in which a bronze alloy is heated above the melting point then cooled to capture the grains in a solid, bronze matrix. The term "active brazing" means that the bronze alloy contains an active material capable of reacting chemically with the abrasive grains usually at elevated temperature and especially when the bronze is molten, i.e., during the brazing step. The reaction chemically links the brazed composition and the grains to provide a stronger bond than that produced by basic brazing. In conventional active brazing the active material normally is only incorporated in the brazing composition.

The present invention basically resides in the discovery that a merely mechanically-bound, macromolecular thickness coating on superabrasive grains of a first active component significantly enhances the ability of a brazing composition containing a second active component to wet the surface of the grains during brazing. Improved wetting lets the molten braze more completely cover the surface area of the grains. Wetting enhancement thus provides more sites for the active components to react with the grains and helps embed the grains more deeply in the solid matrix. The first active component coating on the grains in accordance with this invention increases wetting efficiency such that the amount of second active component in the brazing composition can be greatly reduced. This enables fabrication of a Single Layer tool in which the total active component in the abrasive portion is significantly less than that needed for conventional active brazing.

By the term "mechanically-bound" is meant that prior to brazing the first active component adheres to the superabrasive grains by purely physical means, that is, without direct chemical bonding between the superabrasive and the active component. The thickness of the first active component coating should be macromolecular, that is, many molecules thick. Preferably, the first active component is a fine particulate. In one aspect, the present invention pertains to novel superabrasive grains covered over at least a major fraction of the grain surface area with discrete particles of first active component.

Mechanically-bound, macromolecular coated grain of this invention is contrasted with commercially available coated superabrasive grain generally made by direct vapor bonding technology, such as chemical or physical vapor deposition, to provide extremely thin coatings of one to at most a few molecules of active component on the superabrasive grain surface. Coated superabrasive grain made by commercially used deposition methods does not exhibit a beneficial effect when used in the tools of the invention. Consequently, when using commercially available coated diamond, grain wetting and a strong braze bond can only be achieved by incorporating undesirably large quantities of second active component (e.g., more than 7 wt %) in the brazing composition.

The active components of this invention are selected to accomplish active brazing. Preferably, they are metals compatible with a bronze alloy. By the term "compatible with the bronze alloy" is meant that the active components are able to alloy with the bronze alloy during brazing. The active components additionally should comprise an element or compound capable of reacting with the superabrasive at elevated temperatures at or below brazing temperature. Preferably, the active component should be a carbide forming material for diamond abrasive and a nitride forming material for cubic boron nitride abrasive. The second active component can be chemically the same as or different from the first active component.

The active components can be in elemental form. For example, elemental silicon, chromium, titanium, tungsten, vanadium, molybdenum powders and mixtures of them can be used. Transition metals are preferred, and of these metals, titanium is preferred. The active components can also be present in a compound which decomposes to react during brazing. For example, titanium hydride, $TiH_2$, can be used. $TiH_2$ is stable up to about 500° C., above which it dissociates to titanium and hydrogen. Elemental titanium reacts with water at low temperature to form titanium dioxide and thus becomes unavailable to form carbide or nitride during brazing when water is present. Therefore, $TiH_2$ is a useful first active component for coating superabrasive with titanium when water might be present during brazing, for example as a constituent of the liquid binder. When elemental titanium is used, care must be exercised to select titanium metal powders having larger particle sizes (e.g., at least about 100 microns) and a non-aqueous binder system to avoid premature reaction between the titanium and oxygen or water or compounds other than carbide- or nitride-formers.

A liquid binder can be used to adhere the first active component to the superabrasive grains. In general, the first active component particles and superabrasive grains are brought together in contact with the liquid binder. Initially, the binder exists in the liquid state. The liquid binder subsequently is dried leaving the particles adhesively bound to the surface of the grains. Typically, drying is achieved by removing a volatile portion of the liquid binder, for example by evaporating a volatile solvent.

The liquid binder can be characterized by its susceptibility to drying. The liquid binder preferably should be capable of drying below the temperature of decomposition of active components to their reactive forms. Titanium hydride, for example, decomposes to titanium at about 500° C. The liquid binder thus should be capable of drying below about 450° C. The liquid binder optionally should be capable of drying under vacuum. It might be necessary to dry the liquid binder in the absence of oxygen to prevent oxidation of the active components prior to reaction with the superabrasive.

The liquid binder can be further characterized by the ability to burn cleanly, that is to substantially completely vacate the coated grains upon heating below braze formation temperatures, and preferably below the temperature of reaction between the active component and the superabrasive. The liquid binder should leave minimal residue and any such residue should not significantly interfere with the formation or function of the braze. Carbon residue especially should be minimized to prevent competition with the carbon or nitrogen of the superabrasive for reaction with the active component.

A variety of types of liquid binder are contemplated. For example, the liquid binder can be a liquid prepolymer susceptible to chemical curing to a polymeric mass that adheres the particles to the grains. The liquid binder could be a high boiling liquid or a solution of an adhesive in a volatile solvent. Suitable liquid binders are commercially available. Representative paste-forming binders suitable for use in the present invention include Braz™-Binder Gel from Vitta Company and "S" binder from Wall Colmonoy Corporation, Madison Heights, Mich..

The first active component can be deposited on the superabrasive grains in several different ways, such as by spraying, painting, dipping sputtering or doctoring a mixture of first active component dry powder in liquid binder onto the particles; or by first wetting the superabrasive grains with liquid binder and subsequently sprinkling active component powder onto the wet superabrasive. Thereafter, drying of the liquid binder causes the active component particles to adhere to the grains. Viscosity of the liquid binder generally is not considered critical. However, to prepare mixtures of first active component and liquid binder for dispensing by spraying, painting or like methods could impose viscosity limitations which one of ordinary skill in the art would well understand.

Preferably, the first active component will be applied to the superabrasive as an adhesive paste. The paste provides a convenient form for dispensing accurate amounts of active component and it helps assure that the surface area of the superabrasive grains become effectively covered. A major fraction, i.e., at least 50%, of the grain surface area, and preferably, the entire surface area should be coated to achieve desired results. The adhesive paste is formed by mixing a fine powder of the active component with a liquid binder. The binder is added to the powder in effective proportion to yield a viscous, tacky paste-like consistency similar to that of tooth paste, however, the viscosity of the paste is not critical. Broadly defined, the adhesive paste will be about 30 to about 90 wt % first active component and a complementary amount of liquid binder. One of ordinary skill will be able to determine optimum proportions of powder and liquid binder more precisely for a specific application without undue experimentation. The liquid binder should be mixed with the first active component particles until the composition is homogeneous. Homogeneity usually can be determined by visual observation. Any of various methods and equipment well known in the art for processing pastes such as tumble mills, roll mills, and paddle, bar or blade agitated, stirred tanks can be used to perform the mixing.

Preferably, the first active component should be incorporated into the adhesive paste in fine powder form. Ideally, the powder should be free-flowing. The powder particles should be small enough to provide a thin coating on the surface of the abrasive particles. As mentioned above, the coating thickness should be macromolecular primarily to assure that sufficient active component is present on the surface of the grains during brazing. However, a thick coating can load the brazing composition unnecessarily with excessive active component that becomes available to form undesirable amounts of intermetallic compounds during brazing. To avoid creating too thick of a coating, a preferred maximum particle size of the first active component powder is 325 U.S. standard mesh (44 $\mu$m), and a preferred range is about 4 to 44 $\mu$m. Preferably, a substantial portion of the first active component powder should have particle size of at least about 4 to 10 $\mu$m. The particle size of the active component and the type of liquid binder should be selected to yield a coating thickness of about 4 to 150 microns, preferably 4–50 microns after drying.

The abrasive grains may be of such substances as aluminum oxide, silicon oxide, silicon carbide, tungsten carbide and the like that are harder and thus abrasive to the substance being cut. For Single Layer tools, the abrasive substance preferably should be a superabrasive such as diamond, cubic boron nitride and mixtures of them. Diamond is preferred, primarily for cutting nonferrous materials. Particle size of the abrasive grains generally should be larger than the size of the first active component powder particles, i.e., larger than 325 mesh (44 microns), preferably, larger than about 140 mesh (100 microns), and more preferably larger than about 60 mesh (300 microns).

While the adhesive paste is fluid, it is mixed with abrasive grains to wet the grains. The objective of the mixing operation is to intimately contact the tackified active component powder particles with the abrasive grains so that the grains become suitably coated. This mixing can be accomplished in standard industrial slurry mixing equipment, such as tumble mills, roll mills, and paddle, bar or blade agitated, stirred tanks. Preferably the mixing should be performed at low shear rates to prevent entraining bubbles into the mixture; to avoid heat buildup that could dry the adhesive paste prematurely; and to prevent comminution of the abrasive grains. The abrasive particles can be added directly to the adhesive paste mixing vessel or the adhesive paste and abrasive particles can be transferred to a separate mixing vessel. Other variations are permissible, such as premixing liquid binder with superabrasive grains to form a slurry followed by adding first active component powder to the slurry; and combining a liquid binder/superabrasive grain slurry with a liquid binder/first active component paste. The order of mixing ingredients is thus not critical provided that a uniform concentration, intimate mixture of grains, particles and liquid binder is attained. Degree of wetting of the abrasive grains can be observed by visual inspection. That is, the abrasive grains will appear well mixed in the paste and there will be at most, few lumps of agglomerated abrasive grains present.

A sufficient amount of adhesive paste should be mixed with the abrasive grains to wet at least a major fraction of the surface area of the grains. The upper limit of paste in the mixture is not critical, however, excessive paste can leave an unnecessarily thick coating of first active component on the surface of the grains after drying the liquid binder. As stated above, a very thick coating supplies extra active component to the brazing composition and tends to promote undesirable intermetallic formation. Preferably, a major fraction of the surface are of the abrasive grains will be coated with the first active component powder after drying. The weight percentage of coating on a diamond weight basis after drying is about 5 to 50 weight %, preferably about 5 to 15 weight %.

After the paste is intimately mixed with the abrasive grains, the liquid binder is dried. The term "dried" as applied to the adhesive paste means that the paste is converted from wet to dry form thereby causing the first active component powder particles to become mechanically-bound to the surface of the abrasive grains. Drying conditions will largely be dictated by the type of liquid binder employed. For example, drying can be achieved by polymerizing a liquid prepolymer comprising the liquid binder. Certain liquid binders that include a volatile liquid portion and an adhesive portion can be dried by evaporating the liquid portion to leave a residue which adheres the powder particles to the abrasive grains. Evaporation can be accomplished by heating the adhesive paste-wetted abrasive grains to an elevated temperature below the braze temperature. The evaporation temperature should also be below the decomposition temperature of the first active component. For example, when $TiH_2$ is the active component, evaporation should be carried out below about 450° C. under an inert gas atmosphere, i.e., oxygen-free. Ideally, evaporation temperature should be in the range of about 50°–300° C., and more desirably, about 50°–250° C. Evaporation can be performed in conventional drying equipment such as pan, tray moving bed, or continuous belt kilns, ovens and dryers. The drying and dried abrasive grains should not be agitated excessively to prevent the first active component powder particles from separating from the abrasive grains. To facilitate depositing coated grains onto the cutting tool, the coated grains should be free-flowing. Some drying processes will produce coated grains in a friable cake. Therefore, some mild agitation might be necessary to break up agglomerates.

The novel coated abrasive grains may be used to fabricate a variety of abrasive tools. Superabrasive grains coated according to the present invention are particularly useful for making Single Layer abrasive tools. Generally, conventional tool fabrication processes can be used with the added precaution that the coated grains should not be excessively agitated or otherwise disturbed in ways likely to dislodge the coating from the grains prior to brazing.

The brazing composition which can be used in connection with the novel superabrasive grains to make a Single Layer abrasive tool will include a bronze alloy and a second active component. Preferably, each of the bronze alloy and second active component will be in particulate form. For handling convenience, the brazing composition can additionally include a liquid vehicle in proportion effective to produce a paste. Physical properties of the brazing composition paste are similar to those of the adhesive paste.

The bronze alloy is a basic copper/tin composition consisting essentially of about 10–30 wt % tin and a complementary amount of copper. By "consisting essentially of" is meant that the bronze alloy can also include various amounts of additional elements which generally add to the functionality of the brazed composition without detracting from the operation of the present invention. For example, the bronze alloy can include silver, nickel, carbon, indium and manganese. These additional elements can be present pre-alloyed with the bronze or they can be added as a discrete components of the brazing composition. Each additional element preferably will be in the range of about 0.2 to about 20 parts by weight (pbw) per 100 pbw of copper plus tin, and the total normally will constitute less than half of the brazing composition.

Optionally, some of the second active component can be introduced in the brazing composition with the bronze alloy. That is bronze alloy containing minor fractions of active elements such as titanium, zirconium, tungsten and molybdenum can be used. Preferably, the concentration of each active component in the bronze alloy will be less than about 3 pbw per 100 pbw of the total of copper and tin in the bronze.

The bronze alloy and second active components are preferably supplied as coarse powders. The particle size of such powders is generally larger than the size of the first active component fine powder. That is the nominal particle size of the coarse powder should be at least about 10 $\mu$m. By "nominal particle size" is meant that the coarse powder particles can be smaller than 10 $\mu$m and as small as about 5 $\mu$m. The maximum size of the coarse powder particles is primarily determined by the fusing characteristics of the brazing composition. Preferably, the size should be at most 325 U.S. standard mesh (44 $\mu$m).

The liquid vehicle provides a medium for making a homogenous mixture of the coarse powders. It also provides a convenient means for handling these powders. The liquid vehicle should be sufficiently volatile to substantially completely evaporate and/or pyrolyze during brazing without leaving a residue that might interfere with the formation or function of the braze. Preferably the liquid vehicle will be eliminated below about 400° C. However, the liquid volatility should be low enough that the bond composition remains fluid and tacky at room temperature for a reasonable working time. It is desirable that the working time be sufficiently long enough to apply the brazing composition and abrasive to the core and to prepare the tools for brazing. Preferably the drying time should be less than about 1–2 hours. More preferably, the liquid vehicle can be practically totally evaporated from the bond composition during a drying time of about 5–20 minutes at about 50°–300° C.

Commercially available materials, such as Braz-Binder Gel of Vitta Company and "S" binder of Wall Colmonoy Corporation can be selected for the liquid vehicle according to the present invention. Lucanex™ binder from Lucas Company can also be used. It is obtained as a paste already mixed by the vendor with the bronze alloy and second active components.

Many of the same well known slurry and paste processing methods disclosed above such as tumble milling, roll milling and stirring can be used to mix the components of the brazing composition. The order of mixing powders and liquid vehicle is not critical. The brazing composition will contain about 0.5–7 pbw of second active component per hundred pbw of the total of copper and tin in the bronze alloy component, preferably about 0.5–3 pbw, and more preferably about 0.5–2 pbw. The coating of first active component adds very little to the total amount of active component in the novel bond. For comparison, traditional metal brazing compositions for Single Layer abrasive tools typically contain as much as about 10 pbw of active component. The high concentration of active component was required to wet superabrasive grains sufficiently to provide a strong bond. The present invention, however, features the advantage that much less active components need be present to effect excellent wetting of the grains. These lower amounts make less active component available to form intermetallic phases which weaken the bond between the abrasive and the core and which adversely affect the ability to strip brazed composition from worn tools.

The brazing composition can be coated onto an operative surface of the core by any of the techniques well known in the art, such as brushing, spraying, doctoring or dipping the surface of the tool in the paste. For example, the brazing composition paste can be coated onto the core with the aid of a turning machine. The brazing composition should be placed on the core to a bond effective depth. That is, the thickness of the brazing composition coating will be sufficient to enable the braze to surround and at least partially submerge the abrasive grains during brazing. A layer of novel, coated abrasive grains then is deposited onto the coating of brazing composition. The abrasive grains can be placed individually or sprinkled in a manner to provide even distribution over the cutting surface. The abrasive grains are deposited in a Single Layer, i.e., substantially, one grain thick. It may be necessary to shake, tap or invert the pre-fired tool to remove excess grains.

The abrasive grains are affixed to the core by brazing. Conventional brazing procedures and equipment can be used. Generally, the brazing step involves heating the assembly of abrasive grains embedded in brazing composition disposed on the core. The temperature of the assembly is increased according to a preselected time-temperature program. At lower elevated temperatures, i.e., below about 400°–600° C., the remnants of the volatile and combustible fractions of the liquid binder evaporate and/or pyrolize. Similarly, the liquid vehicle portion of the bond composition burns off at these temperatures. Also at these temperatures, reactive ion-containing active component compounds decompose to liberate the reactive ion. For example, titanium hydride decomposes to elemental titanium and hydrogen. The temperature is increased further to the range of about 800°–950° C. where active brazing of the bronze alloy and active components takes place to bond the superabrasives to the core. The duration of exposure to various temperatures can be chosen to optimize brazing. One of ordinary skill in the art should be able to identify proper time and temperature conditions without undue experimentation.

This invention is now illustrated by examples of certain representative embodiments thereof, wherein all parts, proportions and percentages are by weight unless otherwise indicated. AU units of weight and measure not originally obtained in SI units have been converted to SI units.

EXAMPLES

Example 1

A paste was formed by mixing 80 parts by weight $TiH_2$ powder (Cerac Company, Milwaukee, Wis.) and 20 parts by weight of Vitta Braz-Binder Gel (Vitta Corporation, Bethel, Conn.). Nominal particle size of the $TiH_2$ powder was 325 U.S. standard mesh (44 μm), however, the actual maximum particle size was about 10 μm. The ingredients were added to a crucible and manually stirred with a spatula until the paste had a smooth consistency. Nominally 25 U.S. standard mesh (0.707 mm) natural diamond crystals were added to the paste and mixed by further stirring. After the diamonds were thoroughly wet with the $TiH_2$ paste, the diamond mixture was oven dried at 200° C. for 2 h. The binder was completely evaporated after drying.

Examples 2–6 and Comparative Examples 1–3

The ability of various brazing compositions to braze diamond crystals of Ex. 1 was investigated in a series of braze test experiments described with reference to Table I. Diamond crystals with $TiH_2$ powder coating were prepared as described in Ex. 1. In Comp. Ex. 2, the diamond crystals were not coated. A brazing composition was prepared by blending a copper-tin bronze alloy powder (<325 U.S standard mesh) and $TiH_2$ powder (actual maximum particle size 44 μm) in the proportions shown in Table I together with Vitta Braz-Binder Gel. The composition contained 20 wt % liquid vehicle and 80 wt % solids. The brazing compositions were blended by manual stirring for about ten minutes to form a uniform consistency, viscous paste. A bed of brazing composition was spread to a depth of 6 mm on the top of each of flat, approximately 10 mm wide low carbon steel preform blocks.

Groups of diamond crystals were placed upon the beds of brazing compositions and the blocks were heated to the indicated brazing temperatures for the time shown in Table I. Under these braze conditions, all braze alloy compositions fused around the diamond crystals. The nature of the bond between diamond and braze was observed by visual inspection.

In Comp. Ex. 1, the braze alloy did not wet the surface of the diamonds and the crystals were left sitting in very shallow pools of brazed composition. This structure did not provide a strong bond. In contrast, the brazed compositions of each of Exs. 2–4 formed an ample meniscus around each diamond grain and the grains were deeply submerged within the braze. This morphology indicates that the brazed diamonds bonded strongly to a Single Layer abrasive tool. These examples additionally show that just a very small amount of second active component in the brazing composition is capable of rendering the brazed composition compatible with the coated diamond grains. Although at least about 1.5 parts by weight (pbw) is shown to be sufficient, a smaller amount as low as about 0.5 pbw may be adequate. Furthermore, as seen in Comp. Ex. 2, the brazing composition with low titanium concentration did not adequately wet uncoated diamonds. However, Ex. 3 demonstrates that a mechanically bonded coating of a first active component causes the same 2 pbw titanium in the brazing composition to fully wet the diamond crystals.

TABLE I

| | Braze Alloy Composition (pbw[1]) | | | | First active component | Braze Conditions | |
|---|---|---|---|---|---|---|---|
| | Cu | Sn | Ag | $TiH_2$ | | Temperature °C. | Time min. |
| Comp. Ex. 1 | 77.00 | 23.00 | | | $TiH_2$ | 860.00 | 10.00 |
| Ex. 2 | 77.00 | 23.00 | | 1.50 | $TiH_2$ | 860.00 | 10.00 |
| Ex. 3 | 77.00 | 23.00 | | 2.00 | $TiH_2$ | 860.00 | 10.00 |
| Ex. 4 | 77.00 | 23.00 | | 3.00 | $TiH_2$ | 860.00 | 10.00 |
| Comp. Ex. 2 | 77.00 | 23.00 | | 2.00 | None | 860.00 | 10.00 |
| Ex. 5 | 65.70 | 17.70 | 16.60 | 2.00 | $TiH_2$ | 845.00 | 10.00 |
| Comp. Ex. 3 | 65.70 | 17.70 | 16.60 | 2.00 | None | 845.00 | 10.00 |
| Ex. 6 | 65.70 | 17.70 | 16.60 | 2.00 | Ti | 860.00 | 10.00 |

[1]parts by weight braze composition

The braze test experiments were repeated with a different bronze alloy containing silver in Examples 5–6 and Comp. Ex. 3. Each brazing composition included 2 pbw $TiH_2$. The first active component in Ex. 6 was <325 U.S. standard mesh (<44 μm) elemental titanium powder from Cerac company, Milwaukee, Wis. In Examples 5 and 6 the brazed composition formed a meniscus around the diamond crystals while the identical brazed composition in Comp. Ex. 3 did not. These experiments confirm that coating the diamond grains significantly enhances compatibility between the diamond and brazed composition. Furthermore, Ex. 6 demonstrates that elemental titanium powder is an effective first active component.

Example 7 and Comparative Example 4

Additional braze tests as described above were carried out with the following variations: In Ex. 7, 68 wt % of the TiH2 powder was mixed with 32 wt % proprietary "S" binder of Wall Colmonoy Corporation to form a slurry paste. The paste was mixed with diamond crystals of U.S. standard mesh 20/30 particle size, i.e., between 0.841 and 0.595 mm to wet the diamond. The mixture was oven dried at 175° C. for 2 h to completely evaporate the "S" binder. Thereafter, the coated diamonds and a control of uncoated diamonds, Comp. Ex. 4, were brazed using the brazing composition and conditions indicated in Table II. Effectiveness of the resulting brazed composition was observed by visual inspection. The experiment shows that 2 pbw $TiH_2$ included in the brazing composition did not cause the brazed composition to wet the uncoated diamonds very well. In contrast, the coated diamond crystals were wetted well with the same braze alloy. Based on this experiment, it can be further concluded that the Wall Colmonoy "S" binder can be an effective volatile liquid binder according to the present invention.

TABLE II

| | Braze Alloy Composition (pbw) | | | | First active component | Braze Conditions | |
|---|---|---|---|---|---|---|---|
| | Cu | Sn | Ag | $TiH_2$ | | Temperature °C. | Time min. |
| Comp. Ex. 4 | 65.70 | 17.70 | 16.60 | 2.00 | None | 860.00 | 10.00 |
| Ex. 7 | 65.70 | 17.70 | 16.60 | 2.00 | $TiH_2$ | 860.00 | 10.00 |
| Comp. Ex. 5 | 65.70 | 17.70 | 16.60 | 2.00 | Ti | 860.00 | 10.00 |
| Comp. Ex. 6 | 65 70 | 17.70 | 16.60 | 2.00 | Ti | 860.00 | 10.00 |

Comparative Examples 5–6

Braze tests as in Ex. 7 were repeated except that two types of commercially available titanium coated diamond were substituted for mechanically-coated diamond. In Comp. Ex. 5, 25/30 U.S. standard mesh (0.707–0.595 mm) particle size synthetic diamonds from General Electric Company were used. The diamonds in Comp. Ex. 6 were 40/50 U.S. standard mesh (0.42–0.297 mm) particle size from DeBeers. The titanium coating on the DeBeers diamonds was 0.5 wt % and the amount of titanium on the General Electric diamonds is unknown, but the coating is estimated to be less than about 1 micron in thickness. Brazing with compositions and conditions as shown in Table II were completed.

The brazes did not wet either of the commercially coated diamond samples. Although not known for certain, it is thought that the comparatively thin titanium coating on the commercial diamonds is accomplished by chemical or physical vapor deposition or similar direct bonding method. Such methods produce molecular-scale coating thicknesses. These extremely thin coats do not cause the brazing compositions to wet the diamond. It is believed the commercial titanium coated diamonds lack sufficient unreacted titanium in the coating to cause the braze compositions to wet the diamond.

Although specific forms of the invention have been selected for illustration in the examples, and the preceding description is drawn in specific terms for the purpose of describing these forms of the invention, this description is not intended to limit the scope of the invention which is defined in the claims.

We claim:

1. A process for making an abrasive tool having a metal core comprising the steps of:

(A) mixing to a uniform composition a first active powder component and an effective amount of a liquid binder to form an adhesive paste;

(B) mixing superabrasive grains, each having a surface area, with an effective amount of the adhesive paste to wet a major fraction of the surface area of the superabrasive grains with the paste;

(C) drying the liquid binder thereby producing coated superabrasive grains having a mechanically bound surface coating >1 micron in thickness of the first active powder component;

(D) coating an operative surface of the core with an effective amount of a brazing composition comprising a second active component;

(E) depositing a single layer of coated superabrasive grains into the brazing composition on the operative surface of the metal core;

(F) heating the coated metal core under an inert atmosphere to remove substantially all liquid binder; and (G) brazing the coated superabrasive grains to the core at a temperature of at least 700° C. to effect a reaction between the superabrasive grains, the first active component and the second active component.

2. The invention of claim 1 wherein the coated superabrasive grains have a surface coating of about 4 to 150 microns in thickness of the first active powder component.

3. The invention of claim 1 wherein the first active powder component has a particle size of about 4 to 44 $\mu$m.

4. The invention of claim 1 wherein the superabrasive is selected from the group consisting of diamond and cubic boron nitride.

5. The invention of claim 1 wherein the second active component is present in the brazing composition in the form of a powder of particle size in the range of about 4 to about 150 $\mu$m.

6. The invention of claim 1 wherein the first active component comprises a metal selected from the group consisting of titanium, silicon, chromium, tungsten, vanadium, molybdenum, hafnium, iron, zirconium, and reactive compounds thereof and mixtures thereof.

7. The invention of claim 6 wherein the first active component is selected from the group consisting of elemental titanium and titanium hydride.

8. The invention of claim 1 wherein the second active component comprises a metal selected from the group consisting of titanium, silicon, chromium, tungsten, vanadium, molybdenum, hafnium, iron, zirconium, and reactive compounds thereof and mixtures thereof.

9. The invention of claim 8 wherein the second active component is selected from the group consisting of elemental titanium and titanium hydride.

10. The invention of claim 1 wherein the drying step includes heating the coated superabrasive grains to about 50° C.–300° C. until the liquid in the binder evaporates.

11. The invention of claim 1 wherein the brazing composition comprises (1) 100 parts by weight of a coarse powder of a bronze alloy consisting essentially of about 10–30 wt % tin and a complementary amount of copper;

(2) about 0.5–7 parts by weight coarse powder of a second active component; and (3) about 15–30 parts by weight of a liquid vehicle.

12. The invention of claim 11 wherein the total of first active component and second active component is less than about 5 parts by weight per 100 parts by weight of bronze alloy.

13. The invention of claim 11 wherein the second active component is about 0.5 to 3.0 parts by weight per 100 parts by weight of bronze alloy.

14. The invention of claim 11, wherein the brazing is carried out by heating the coated metal core to a temperature of 750° to 950° C. for 5 to 30 minutes under a non-oxidizing atmosphere.

* * * * *